US005607634A

United States Patent [19]

Makino et al.

[11] Patent Number: 5,607,634

[45] Date of Patent: Mar. 4, 1997

[54] HIGH SPEED PROCESS FOR PRODUCING POLYESTER FILAMENTS

[75] Inventors: Shoji Makino, Takatsuki; Katsutoshi Taniguchi, Matsuyama, both of Japan

[73] Assignee: Teijin Limited, Osaka, Japan

[21] Appl. No.: 537,250

[22] Filed: Sep. 29, 1995

Related U.S. Application Data

[63] Continuation of Ser. No. 371,170, Jan. 11, 1995, Pat. No. 5,507,989, which is a continuation-in-part of Ser. No. 150, 137, Nov. 29, 1993, abandoned.

[30] Foreign Application Priority Data

Apr. 1, 1992 [JP] Japan ..... 4-79771

[51] Int. Cl.[6] ..... D06M 13/224; D06M 15/53

[52] U.S. Cl. ..... 264/130; 264/210.3

[58] Field of Search ..... 264/130, 210.3, 264/210.8; 252/8.6

[56] References Cited

U.S. PATENT DOCUMENTS

| | | | |
|---|---|---|---|
| 2,838,455 | 6/1958 | Tompkins | 252/8.6 |
| 3,452,132 | 6/1969 | Pitzl | 264/210.8 |
| 3,770,861 | 11/1973 | Hirano et al. | 264/130 |
| 4,064,057 | 12/1977 | Koerner et al. | 252/8.6 |

FOREIGN PATENT DOCUMENTS

| | | | |
|---|---|---|---|
| 52-18993 | 2/1977 | Japan . | |
| 53-2625 | 1/1978 | Japan | 264/130 |
| 58-51544 | 11/1983 | Japan . | |
| 59-59978 | 4/1984 | Japan . | |
| 60-81375 | 5/1985 | Japan . | |
| 61-12921 | 1/1986 | Japan | 264/210.3 |
| 62-15319 | 1/1987 | Japan . | |
| 63-112769 | 5/1988 | Japan . | |
| 64-33211 | 2/1989 | Japan | 264/210.3 |
| 2-47361 | 2/1990 | Japan . | |
| 2-242977 | 9/1990 | Japan . | |
| 3-40867 | 2/1991 | Japan . | |
| 3-59172 | 3/1991 | Japan . | |
| 3-51804 | 8/1991 | Japan . | |
| 3-249280 | 11/1991 | Japan . | |

OTHER PUBLICATIONS

"Polymer Processing, Fiber–Formation of Synthetic Fibers and Fine chemicals, Development of Oiling Agents for Synthetic Fibers" Apr. 1992, General explanation of Synthetic Fibers.

*Primary Examiner*—Robert Davis
*Attorney, Agent, or Firm*—Burgess, Ryan and Wayne

[57] ABSTRACT

A high speed process for producing polyester filaments, in which process the formation of fluffs and the occurrence of filament breakage are very slight and a package having a good winding appearance can be stably obtained, by melt spinning polyester filaments at a taking-up speed of 3000 m/minute or more, while applying an aqueous emulsion of an oiling agent to the filaments, the oiling agent includes 50% by weight or more of a monobasic acid ester of a $C_{10-18}$ aliphatic monocarboxylic acid with a $C_{4-18}$ aliphatic monohydric alcohol and having an average molecular weight of 300 to 500; 1 to 15% by weight of a polyoxyalkylene glycol copolymer having an average molecular weight of 1,000 to 30,000; and 0.1 to 3% by weight of an organic siloxane compound and/or a fluoroalkyl ($C_{3-18}$) group-containing compound.

4 Claims, No Drawings

HIGH SPEED PROCESS FOR PRODUCING POLYESTER FILAMENTS

CROSS REFERENCE TO RELATED APPLICATION

This is a continuation of application Ser. No. 08/371,170, filed Jan. 11, 1995 and now U.S. Pat. No. 5,507,989, which is a continuation-in-part of our application Ser. No. 08/150,137 filed on Nov. 29, 1993 abandoned.

BACKGROUND OF THE INVENTION

1) Field of the Invention

The present invention relates to a high speed process for producing polyester filaments. More particularly, the present invention relates to a high speed process by which polyester filaments having a high quality can be produced with a high process stability at a speed of 3000 m/minute or more.

2) Description of Related Art

In recent years, significant progress has been made in the technology of producing synthetic filaments. In particular, due to the development of high speed winders, spinning speed has increased stability. High speed filament-producing technology also enables extrusion producibility to be enhanced. The resultant product exhibits special properties derived from a specific change in the microstructure of the filament generated in the spinning procedure thereof. Accordingly, with respect to developments in new uses of the product utilizing these special properties, various research and development projects are being carried out.

The increase in the filament-forming speed, however, causes various problems such as friction between the moving filament yarns and various yarn guiding means (rollers and guides), friction between filaments in a moving filament yarn bundle being increased, breakage of individual filaments and breakage of filament yarns due to the breakage of the individual filaments being promoted, the resultant filament yarns exhibiting a lowered quality, and the production efficiency being rather reduced.

To eliminate the above-mentioned problems, many proposals were made regarding oiling agents and oiling methods for spun filament yarns, and for air treatment of filament bundles to enhance the bundling property of the moving filaments.

The proposals concerning oiling agents are still not satisfactory or sufficient to solve the existing problems. No highly effective means for solving these problems has been reported at the present.

SUMMARY OF THE INVENTION

An object of the present invention is to provide a high speed process for producing polyester filaments in which breakage of individual filaments and filament yarns during a filament-forming procedure is slight and a wound filament yarn package with a good appearance can be stably formed.

The inventors of the present invention made an effort to attain the above-mentioned object and as a result, discovered that in the high speed process for producing polyester filaments, application of an oiling treatment emulsion comprising a specific oiling agent composition is very important. The present invention was completed on the basis of this discovery.

The high speed process of the present invention for producing polyester filaments comprises melt-spinning polyester filaments at a taking-up speed of at least 3000 m/minute, while an aqueous emulsion of an oiling agent is applied to the polyester filaments, wherein the oiling agent comprises:

(A) at least 50% by weight of a principal component consisting of at least one member selected from monobasic acid esters of aliphatic monocarboxylic acids with 10 to 18 carbon atoms with aliphatic monohydric alcohols with 4 to 18 carbon atoms and having an average molecular weight of 300 to 500; and (B) additional components comprising:

(a) 1 to 15% by weight of at least one polyoxyalkylene glycol copolymer with an average molecular weight of from 1,000 to 30,000, and (b) 0.1 to 3% by weight of at least one member selected from the group consisting of organic siloxane compounds and fluoroalkyl group-containing compounds of which the fluoroalkyl group has 3 to 18 carbon atoms.

DESCRIPTION OF THE PREFERRED EMBODIMENTS

The present invention is mainly directed to a production of filaments of a polyester having, as main recurring units, alkylene terephthalate units, for example, polyethylene terephthalate, and applied to polyester filaments which have been melt-spun at a taking-up speed of at least 3000 m/minute, preferably 3500 to 4000 m/minutes, and then being drawn.

When the taking-up speed is less than 3000 m/min, the above-mentioned problems concerning the process conditions and quality of the resultant product never occur, and thus it is not necessary to apply the present invention thereto. The specific oiling agent usable for the present invention can exhibit the specific effect thereof only when the fiber-forming procedure is carried out at a taking-up speed of 3000 m/min or more.

In the present invention, it is necessary that the oiling agent be diluted with water to provide an aqueous emulsion thereof and the aqueous oiling agent emulsion must be applied to the polyester filaments melt-spun at high speed, to smoothly impart the oiling agent to the polyester filaments moving at high speed. A conventional oiling agent containing no water, namely a so-called straight oiling agent, has a high viscosity and exhibits a poor wetting performance for moving filaments. Therefore, fluffs are often generated in the resultant polyester filaments, or an excessively high load is applied to the moving filaments when oiled, and thus the individual filaments are often broken.

In the present invention, the monobasic acid ester usable as a principal component of the oiling agent is necessarily contained in a content of at least 50% by weight, preferably 50 to 75% by weight, based on the total effective content weight of the oiling agent, in the oiling agent. If the content is less than 50% by weight, the resultant oiling agent cannot impart the lubricating performance necessary for the melt-spinning procedure at a high speed of 3000 m/min or more, to the filaments, and thus fluff-formation and the individual filament breakage are undesirably increased.

The monobasic acid ester usable for the present invention is a monoester compound of a monovalent aliphatic carboxylic acid with 10 to 18 carbon atoms with a monovalent aliphatic alcohol with 4 to 18 carbon atoms, and has an average molecular weight of 300 to 500, preferably 350 to 450. This type of monobasic acid ester is preferably selected from the group consisting of octyl palmitate, octyl stearate, lauryl laurate, 2-ethyl-hexyl stearate, isotridecyl palmitate and isostearyl caprylate.

Where a monobasic acid ester having a molecular weight of more than 500, or a multi-basic acid ester having a valency of two or more is employed, in the filament-forming procedure, the friction between the moving filaments and the yarn guiding means is increased and thus undesirable fluff formation and the filament breakage of the resultant polyester filaments increase. Also, when a monobasic acid ester having a molecular weight of less than 300 is employed in the filament-forming procedure, in the successive drawing or heat-treating procedure, smoke is generated due to heating, and thus an undesirable problem of pollution of the process environment occurs.

In the oiling agent usable for the present invention, the polyoxyakylene glycol copolymer usable as an additional indispensable component (a) is employed to effectively enhance the strength of oil membranes formed on the peripheral surfaces of the oiled polyester filaments and to impart an enhanced abrasion resistance and anti-friction property to the filaments. In the present invention, it was found that, due to the above-mentioned specific effect, the friction between the high speed moving filaments and the filament-guiding means and the friction of the filaments with each other are effectively reduced, and thus polyester filaments having a significantly reduced number of fluffs can be produced at a high efficiency, without breaking.

In a conventional method, it was proposed to add a high polymerization product of hydrogenated caster oil or a polyester of a polyhydric alcohol to an oiling agent. In this method, a certain extent of the desired effect was obtained. However, in order to attain the required effect for the high speed filament-forming procedure, it is necessary to use a large amount of the oiling agent. The application of the large amount of the oiling agent results in an excessively reduced friction coefficient of the filaments in relation to each other and thus the resultant wound filament package formed at high speed exhibits an unstable form, the procedure efficiency is lowered and the unwinding property of the filaments in the package in an after-processing procedure becomes bad.

The inventors of the present invention studied how to solve the above-mentioned problems. As a result, it was found that the stability in the filament package form depends on the filament-to-filament static friction value under a relatively low load, and the value of frictional stress applied to the polyester filaments during the high speed filament-forming procedure is variable depending on the value of the filament-to-filament static friction at a high temperature under a high load. Accordingly, the inventors of the present invention studied the components of the oiling agent which exhibit a high effect in reduction of the later static friction and a low effect in reduction of the former static friction. As a result, it was found that the addition of a specific amount of the polyoxyalkylene glycol copolymer having a specific molecular weight is effective. Namely, the indispensable component (a) of the oiling agent usable for the present invention is a polyoxyalkylene glycol copolymer with an average molecular weight of from 1,000 to 30,000, and must be contained in a content of 1 to 15% by weight based on the total effective component weight in the oiling agent. When the content is less than 1% by weight, the effect on enhancement of the oiling agent membrane strength becomes unsatisfactory. If the content is more than 15% by weight, the resultant oiling agent exhibits an increased viscosity, and whereas the moving filament yarns exhibit an increased dynamic frictional coefficient due to the increased viscosity so as to promote the formation of fluffs on the yarns, the static frictional coefficient of the moving filament yarns is reduced so that the resultant yarn package exhibits a bad winding appearance and stability.

Also, when the component (a) is employed in an excessively large amount, the resultant oiling agent causes a size layer formed on the oiled filament yarns in an after-treatment to be softened so as to reduce the sizing effect of the size layer, or to be removed during a weaving procedure so as to reduce the efficiency of the weaving procedure.

Further, when the average molecular weight of the component (a) is less than 1000, it becomes impossible to attain the object of the present invention, because the resultant oiling agent exhibits an unsatisfactory cohesive force and thus the enhancing effect in the resultant oiling agent membrane strength becomes insufficient.

The polyoxyalkylene glycol copolymers usable for the present invention is preferably selected from ethylene oxide/propylene oxide copolymers having side chains, for example, alkyl groups, and ethylene oxide/tetrahydrofuran copolymers having no side chains (copolymers consisting of oxyethylene units and oxy tetramethylene units). The terminal hydroxyl groups of the above-mentioned copolymers may be blocked with alkyl, aryl or acyl groups or not blocked. Among the above-mentioned copolymers, when the ethylene oxide/propylene oxide copolymers are employed, it is preferable that the copolymers having an average molecular weight of 9000 or more, more preferably having a polymerization ratio (EO/PO weight ratio) of from 20/80 to 80/20 and a molecular weight of 9000 to 30,000, be employed in an amount of 4 to 15% by weight. When the ethylene oxide/tetrahydrofuran copolymers are employed, it is preferable that the copolymers having a copolymerization weight ratio of these comonomers to each other of from 20/80 to 80/20 and an average molecular weight of 1000 to 7000 be employed in an amount of 1 to 10% by weight, more preferably 1 to 5% by weight. Particularly, when the ethylene oxide/tetrahydrofuran copolymers having no side chain are used, they exhibit an excellent improving effect on the oiling agent membrane strength, and thus the restriction effect on the fluff formation and the filament or yarn breakage of the polyester filament yarns is advantageously very high.

When the average molecular weight of the polyoxyalkylene glycol copolymers is more than 30,000, the resultant oiling agent exhibits an excessively high viscosity and thus the resultant high speed moving filament yarns exhibit an excessively enhanced dynamic friction, and the resultant oiling agent emulsion exhibits a reduced stability and a scum is generated and deposited in the emulsion. Therefore, the average molecular weight of the polyoxyalkylene glycol copolymers to be employed should be selected in consideration of the type of the copolymers.

Another additional indispensable component (b) usable for the present invention consisting of at least one member selected from organic siloxane compounds and fluoroalkyl group-containing compounds is contained in an amount of 0.1 to 3% by weight preferably 0.5 to 2% by weight, based on the total weight of the effective components in the oiling agent. By employing the component (b) together with component (a), the resultant oiling agent emulsion exhibits a reduced surface tension, the uniform adhesion of the oiling agent on the high speed moving filament yarns is improved, simultaneously a resistance of the filament yarns generated when they come into contact with the oiling agent emulsion is reduced, and thus the uniformity in quality of the filament yarns and the smoothness in the filament-forming procedure are significantly improved. Particularly, where the oiling agent emulsion exhibits a surface tension of 30 dyne/cm or less, the addition of the component (b) causes the uniform adhesion of the oiling agent to be significantly enhanced, the contact stress generated when the filament yarns come into contact with the emulsion is reduced, and thus the resultant oiling agent is effectively employed for a high speed filament-forming procedure at a speed of 3,000 m/min or more. The above-mentioned surface tension values are determined by the Wilhelmy method at 30° C. When the amount of the component (b) is less than 0.1% by weight, the above-mentioned effect sometimes cannot be obtained, and when the amount of the component (b) is more than 3% by weight, sometimes, the resultant oiling agent exhibits a reduced stability and an uneven dyeing phenomenon occurs on the oiled filament yarns.

The organic siloxane compounds causing the surface tension of the resultant oiling agent emulsion to be reduced include various modified silicones, for example, amino-modified silicones, polyether-modified silicones, and polyester-modified silicones, and other organic silicone compounds, for example, dimethyl silicones, having a low viscosity of 30 cst at 25° C.

Preferably, the oranic siloxane compounds are selected from those of the formula:

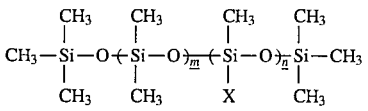

wherein X represents a member selected from the groups of those having the formulae:

$-(CH_2)_3-NH-CH_2CH_2NH_2$, $-(CH_2)_3-O-(C_2H_4O)_a(C_3H_6O)_bCH_3$,

—COR, and $-CH_3$ n represents an integer of 1 to 30, m represents zero or an integer of 1 to 10, and ratio of m to n is in the range of from 1:1 to 1:0, a represents an integer of 1 to 40, b represents zero or an integer of 1 to 40, and R represents an alkyl group having 9 to 17 carbon atoms.

The organic siloxane compounds preferably have a viscosity of 100 cst or less, more preferably 30 cst or less at a temperature of 25° C. A most preferable organic siloxane compound is a polyether-modified siloxane compound having a viscosity of 30 cst or less at a temperature of 25° C.

The fluoroalkyl group-containing compounds usable for the present invention have a fluoroalkyl group with 3 to 18 carbon atoms, more preferably 6 to 12 carbon atoms include, for example, perfluoroalkylethers, perfluoroalkyl sulfonates, and perfluoroalkyl sulfonic acid amides.

The fluoroalkyl group-containing compounds are preferably selected from those of the formulae:

$R_f\ CH_2CH_2O(C_2H_4O)_p(C_3H_6O)_qH$, $R_f\ CH_2CH_2O(C_2H_4O)_pSO_3Na$, and $R_f\ SO_2N(C_2H_5)(C_2H_4O)_pH$ wherein $R_f$ represents a perfluoroalkyl group having 3 to 18 carbon atoms, more preferably 6 to 12 carbon atoms, p and q respectively and independently from each other represent zero or an integer of 1 or more.

The fluoroalkyl group-containing compounds preferably have an average molecular weight of 5,000 or less, more preferably 500 to 3,000.

In the oiling agent usable for the present invention, it is important that it comprises, as indispensable components, three components. Further, the oiling agent optionally contains a usual emulsifying agent, higher alcohol, higher fatty acid, glycol compounds, and a small amount of an additive consisting of an organic or inorganic compound, antistatic agent, and amide compound, for example, diethanol amide of a fatty acid.

As mentioned above, a significant action and effect, which have never been obtained in the prior art, can be obtained by applying a specific oiling agent comprising three indispensable components as mentioned above in a high speed filament-forming procedure at a speed of 3000 m/min or more. If any one of the three components is omitted, the excellent advantage of the present invention cannot be obtained.

The stages at which the oiling agent emulsion is applied in accordance with the present invention is not limited to specific occasions, as long as it is after the melt-spun polyester filament yarns are solidified. Usually, the emulsion is applied to the yarns in front of a taking-up roller. As preferable applying means, the oiling agent emulsion of the present invention is applied to the yarns, for example, to an extent such that an effective component of the oiling agent is imparted to the yarns in an amount of 0.35 to 1.0% based on the weight of the yarn through a metering oiling nozzle. The application method is, however, not limited to the above-mentioned one.

In a melt-spinning procedure at a high speed of 3000 m/min or more, to produce stably uniform polyester filament yarns it is important that the oiling agent be uniformly applied to the filament yarns moving at a high speed, while making a tension load applied to the moving filament yarns between an extruding output and a first taking-up roll as small as possible, and that the friction of the filaments moving at a high speed in relation to each other be reduced.

In the method of the present invention, by using the oiling agent in the form of an aqueous emulsion as mentioned above, the viscosity of the emulsion can be reduced, and by using the specific siloxane compound or fluorine-containing compound (component (b)) together with the component (a), the emulsion surface tension can be reduced, and thus the uniform adhesion of the oiling agent to the filament yarns moving at a high speed can be enhanced and the load stress generated due to a contact of the oiling applying device with the filament yarns can be reduced.

In the oiling agent of the present invention, since the polyoxyalkylene glycol copolymer (component (a)) is contained in a specific amount, the resultant oiling agent system, as a whole, can cause the oiling agent membrane strength to be enhanced to such an extent that even in the filament-forming conditions at a speed of 3000 m/min or more, the resultant oiling agent membrane becomes satisfactorily resistive to the load applied to the filament yarns, and thus a reduction in the lubricating performance of the oiling agent membrane can be prevented, namely, the reduction in high pressure lubricating performance is small.

Further, since a lubricant comprising a specific monobasic acid ester is contained as a principal component in the oiling agent, the resultant oiling agent exhibits, as a whole, a low viscosity, and thus a friction between the filament yarns moving at a high speed and yarn-guiding members can be reduced.

By combining the effects of the above-mentioned components with each other, it becomes possible to stably produce polyester filament yarns having fewer fluffs and a high quality, and the winding appearance and stability of the resultant yarn package becomes satisfactory.

The oiling agent-adhered polyester filament yarns produced by the method of the present invention exhibit an excellent resistance to friction between metal and filaments and between filaments with each other, and thus the weaving procedure can be effected, without difficulty and disturbance. Also, since the polyester filament yarns of the present invention are produced by a high speed filament-forming procedure, a fabric (woven fabric or knitted fabric) having a good touch can be produced.

EXAMPLES

The present invention will be further explained by the following examples.

In the examples, the number of fluffs in the filament yarns and the friction resistance of the filament yarns were determined in the following manner, respectively.

(1) The fluff number of the filament yarns

With respect to a sample consisting of 160 filament yarns each having 400,000 m, the total number of fluffs (broken individual filaments) was counted, and from the data the number of fluffs per $10^6$ m of the filament yarns was calculated. The test results were classified into three classes as shown in Table 1.

TABLE 1

| The number of fluffs per $10^6$m of yarns | Class |
|---|---|
| 0 to 0.1 | 3 |
| 0.2 to 0.5 | 2 |
| 0.5 or more | 1 |

(2) Friction resistance

The friction resistance of the filaments in relation to a metal (F/M) and the friction resistance between the filaments with each other (F/F) were measured by the methods as shown in Table 2, respectively.

TABLE 2

| Item | Tester | Specimen | Testing conditions | Evaluation |
|---|---|---|---|---|
| F/M | TM-type yarn cohesion tester (made by Daiei Kagaku Seiki K.K.) | The number of yarns: 10 | Bending angle: 110 degrees Load: 500 g Fretting speed: 150 fretting strokes/min | The formation of fluffs after 5000 fretting strokes was observed. |
| F/F | Senkoshiki yarn friction cohesion tester (made by Toyo Sokki K.K.) | The number of yarns: 5 | Twist number: 3 turns Crossing angle: 35 degrees Load: 500 g Fretting speed: 200 fretting strokes/min | The formation of fluffs after 600 fretting strokes was observed. |

The Standard of Evaluation

| Class | Formation of fluffs |
|---|---|
| 3 | Substantially no fluff was found. |
| 2 | Fluffs were formed. |
| 1 | The filament yarn was broken. |

Examples 1 to 7 and Comparative Examples 1 to 8

In each of Examples 1 to 7 and Comparative Examples 1 to 8, a yarn consisting of 36 filaments were produced by melt extruding a polyethylene terephthalate resin having an intrinsic viscosity [η] of 0.64. After solidifying, a 10% aqueous emulsion of the oiling agent comprising the components as shown in Table 3 was applied in a total amount of 0.4% by weight of effective components based on the weight of the yarn to the filament yarn by using a metering oiling nozzle. Then, the oiled filament yarn was taken up through a taking-up roller at a peripheral speed of 4000 m/min, and successively drawn at a draw ratio of 1.5 between the taking-up roller and a drawing roller. A drawn yarn having a yarn count of 50 denier/36 filaments was obtained. The resultant filament yarn was subjected to the above-mentioned tests and the test results were evaluated. The evaluation results are shown in Table 3.

In Table 3, the surface tension was measured at a temperature of 30° C. by using a surface tension tester made by Kyowa Kagaku K.K.

In Table 3, the EO-modified silicone is a polyether-modified siloxane compound of the formula:

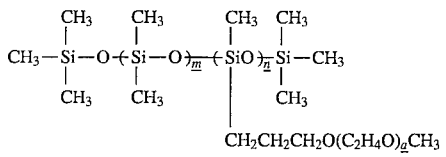

wherein m=2, n=2 and a=10, and having a viscosity of 100 cst at a temperature of 25° C.

Also, in Table 3, the perfluoroalkyl ether is a compound of the formula:

$$C_7H_{15}CH_2-O-(C_2H_4O)_{10}-H$$

TABLE 3

| Item | Example No. | | | | | | | | |
|---|---|---|---|---|---|---|---|---|---|
| | Comparative Example 1 | Example 1 | Comparative Example 2 | Example 2 | Example 3 | Comparative Example 3 | Comparative Example 4 | Comparative Example 5 | Example 4 |
| Composition of oiling agent | | | | | | | | | |
| Octyl decanate (MW284) | 60 | | | | | | | | |
| Octyl stearate (MW396) | | 60 | | 60 | 60 | 60 | 60 | 64 | 60 |
| Oleyl oleate (MW532) | | | 60 | | | | | | |
| PTMG/EO(30/70) (MW800) | | | | | | 5 | | | |
| PTMG/EO(30/70) (MW5500) | 5 | 5 | 5 | | | | 5 | | 5 |
| PO/EO(25/75) (MW10000) | | | | 10 | 15 | | | | |
| EO-modified silicone | 2 | 2 | 2 | | 1 | 2 | | 3 | |
| Perfluoroalkyl ether | | | | 1 | 2 | | | | 2 |

TABLE 3-continued

| | | | | | | | | | |
|---|---|---|---|---|---|---|---|---|---|
| EO-added Alkyl ($C_{12-14}$) ether | 8 | 8 | 8 | 8 | 4 | 8 | 9 | 8 | 8 |
| EO-added hydrogenated castor oil ether | 15 | 15 | 15 | 10 | 7 | 15 | 16 | 15 | 15 |
| Na-EO-added lauryl phosphate | 3 | 3 | 3 | 6 | 6 | 3 | 3 | 3 | 3 |
| Na-EO-added alkyl ($C_{12-14}$) sulfonate | 3 | 3 | 3 | | | 3 | 3 | 3 | 3 |
| Others | 4 | 4 | 4 | 5 | 5 | 4 | 4 | 4 | 4 |
| Evaluation result | | | | | | | | | |
| Surface tension (dyne/cm) | 28.7 | 28.2 | 28.4 | 27.2 | 25.6 | 27.9 | 32.1 | 27.4 | 26.9 |
| The number of fluffs in filament yarn | 1 | 3 | 1 | 3 | 3 | 1 | 1 | 1 | 3 |
| Friction resistance | | | | | | | | | |
| F/M | 2 | 3 | 3 | 3 | 3 | 3 | 2 | 2 | 3 |
| F/F | 1 | 3 | 3 | 3 | 3 | 2 | 3 | 1 | 3 |
| Note | $(*)_1$ | — | — | — | — | — | — | — | — |
| General evaluation | Bad | Good | Bad | Good | Good | Bad | Bad | Bad | Good |

| | Example No. | | | | | |
|---|---|---|---|---|---|---|
| | Comparative Example | | | Example | | |
| Item | 6 | 7 | 8 | 5 | 6 | 7 |
| Composition of oiling agent | | | | | | |
| Octyl decanate (MW284) | | | | | | |
| Octyl stearate (MW396) | 45 | 60 | 60 | 60 | 50 | 75 |
| Oleyl oleate (MW532) | | | | | | |
| PTMG/EO(30/70) (MW800) | | | | | | |
| PTMG/EO(30/70) (MW5500) | | 0.5 | | 5 | 10 | 2 |
| PO/EO(25/75) (MW10000) | 10 | | 18 | | | |
| EO-modified silicone | 3 | 3 | 2 | 1 | 0.5 | |
| Perfluoroalkyl ether | | | | 1 | | 2 |
| EO-added Alkyl ($C_{12-14}$) ether | 10 | 8 | 5 | 8 | 10 | 4 |
| EO-added hydrogenated castor oil ether | 16 | 15 | 5 | 15 | 17 | 7 |
| Na-EO-added lauryl phosphate | 5 | 4 | 3 | 3 | 4 | 3 |
| Na-EO-added alkyl ($C_{12-14}$) sulfonate | 4 | 4 | 3 | 3 | 4 | 3 |
| Others | 7 | 5.5 | 4 | 4 | 4.5 | 4 |
| Evaluation result | | | | | | |
| Surface tension (dyne/cm) | 27.3 | 27.4 | 28.3 | 26.6 | 29.3 | 25.8 |
| The number of fluffs in filament yarn | 1 | 2 | 3 | 3 | 3 | 3 |
| Friction resistance | | | | | | |
| F/M | 3 | 2 | 3 | 3 | 3 | 3 |
| F/F | 2 | 2 | 3 | 3 | 3 | 3 |
| Note | — | — | $(*)_2$ | — | — | — |
| General evaluation | Bad | Bad | Bad | Good | Good | Good |

Note:
$(*)_1$ --- In drawing, remarkable smoking occurred.
$(*)_2$ --- Resultant package appearance was bad.

Example 8

The same procedures and tests in Example 1 were carried out except that the EO-modified silicone was replaced by dimethyl silicone having a viscosity of 10 cst at a temperature of 25° C.

The test results are shown in Table 4.

Example 9

The same procedures and tests in Example 1 were carried out except that the EO-modified silicone was replaced by the amino-modified siloxane compound of the formula:

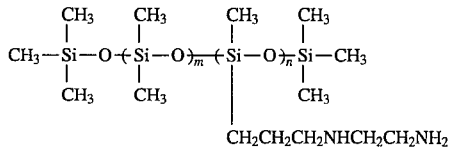

wherein m=3 and n=1, having a viscosity of 60 cst at a temperature of 25° C.

The test results are shown in Table 4.

Example 10

The same procedures and tests in Example 1 were carried out except that the EO-modified silicone was replaced by the ester-modified siloxane compound of the formula:

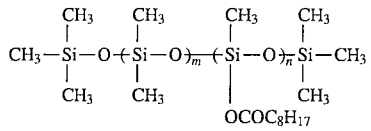

wherein m=3 and n=1, having a viscosity of 30 cst at a temperature of 25° C.

The test results are shown in Table 4.

Example 11

The same procedures and tests in Example 2 were carried out except that the perfluoroalkyl ether was replaced by the perfluoroalkyl compound of the formula:

$$C_8F_{17}SO_2N(C_2H_5)(C_2H_4O)_{10}H$$

The test results are shown in Table 4.

Example 12

The same procedures and tests in Example 2 were carried out except that the perfluoroalkyl ether was replaced by the perfluoroalkyl compound of the formula:

$$C_8F_{17}CH_2CH_2O(C_2H_4O)_{10}SO_3Na.$$

The test results are shown in Table 4.

TABLE 4

| Item | Example No. 8 | 9 | 10 | 11 | 12 |
|---|---|---|---|---|---|
| Surface tension (dyne/cm) | 28.4 | 28.6 | 27.8 | 26.9 | 27.2 |
| The number of fluffs in filament yarn | 3 | 3 | 3 | 3 | 3 |
| Friction resistance | | | | | |
| F/M | 3 | 3 | 3 | 3 | 3 |
| F/F | 3 | 3 | 3 | 3 | 3 |

Industial Applicability

The high speed process of the present invention for producing polyester filaments can cause the load to be applied to the filament yarns in an oiling step to be reduced, and friction between the filaments and metal members and between the filaments with each other to be appropriately reduced, and thus can produce polyester filament yarns having fewer fluffs and an excellent resistance to abrasion at a high speed. Therefore, the process of the present invention is very useful for practical use.

We claim:

1. A high speed process for producing polyester filaments comprising melt spinning polyester filaments at a taking-up speed of at least 3,000 m/minute while an aqueous emulsion of an oiling agent is applied to the polyester filaments, wherein the oiling agent consists essentially of:

(A) at least 50% by weight of a principal component consisting of at least one member selected from monobasic acid esters of aliphatic monocarboxylic acids with 10 to 18 carbon atoms with aliphatic monohydric alcohols with 4 to 18 carbon atoms and having an average molecular weight of 300 to 500; and (B) an additional component comprising:

(a) 1 to 15% by weight of at least one ethylene oxide-propylene oxide copolymer with an average molecular weigh of 9,000 to 30,000 and (b) 0.1 to 3% by weight of at least one organic siloxane compound of the formula:

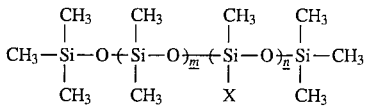

wherein X represents a member selected from the groups of the formulae:

$$-(CH_2)_3-NH-CH_2CH_2NH_2,$$

$$-(CH_2)_3-O-(C_2H_4O)a\ (C_3H_6O)bCH_3$$

$$-COR, \text{ and}$$

$$-CH_3$$

n represents an integer of 1 to 30, m represents zero or an integer of 1 to 10, and the ratio of m to n is in the range of from 1:1 to 1:0, a represents an integer of 1 to 40, b represents zero or an integer of 1 to 40, and R represents an alkyl group having 9 to 17 carbon atoms.

2. The high speed process for producing polyester filaments as claimed in claim 1, wherein the aqueous emulsion of the oiling agent has a surface tension of 30 dyne/cm or less.

3. The high speed process for producing polyester filaments as claimed in claim 1, wherein the monobasic acid ester is selected from the group consisting of octyl palmitate, octyl stearate, lauryl laurate, 2-ethylhexyl stearate, isotridecyl palmitate and isostearyl caprylate.

4. The high speed process for producing polyester filaments as claimed in claim 1, wherein the organic siloxane compound has a viscosity of 100 cSt or less at a temperature of 25° C.

* * * * *